US010203625B2

(12) United States Patent
Kuramochi et al.

(10) Patent No.: US 10,203,625 B2
(45) Date of Patent: Feb. 12, 2019

(54) ELECTROPHOTOGRAPHIC IMAGE FORMING APPARATUS

(71) Applicant: KONICA MINOLTA, INC., Tokyo (JP)

(72) Inventors: Kazuhiro Kuramochi, Hino (JP); Seisuke Maeda, Hussa (JP); Kuniaki Kashiwakura, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/837,586

(22) Filed: Dec. 11, 2017

(65) Prior Publication Data

US 2018/0164710 A1 Jun. 14, 2018

(30) Foreign Application Priority Data

Dec. 14, 2016 (JP) ..... 2016-241928

(51) Int. Cl.
*G03G 5/147* (2006.01)
*G03G 15/02* (2006.01)

(52) U.S. Cl.
CPC ..... *G03G 15/0233* (2013.01); *G03G 5/147* (2013.01)

(58) Field of Classification Search
CPC ... G03G 5/0507; G03G 5/147; G03G 5/14708
See application file for complete search history.

(56) References Cited

U.S. PATENT DOCUMENTS 8,126,354 B2 * 2/2012 Tanaka ..... G03G 9/0819 399/100

FOREIGN PATENT DOCUMENTS

| | | | | |
|---|---|---|---|---|
| JP | 2005156653 A | | 6/2005 | |
| JP | 2011-069906 | * | 4/2011 | ..... G03G 5/05 |
| JP | 2011-128546 | * | 6/2011 | ..... G03G 5/147 |
| JP | 2011141484 A | | 7/2011 | |

OTHER PUBLICATIONS

Translation of JP 2011-128546.*
Translation of JP 2011-069906.*

* cited by examiner

*Primary Examiner* — Peter L Vajda
(74) *Attorney, Agent, or Firm* — Lucas & Mercanti, LLP

(57) ABSTRACT

An electrophotographic image forming apparatus includes: an electrophotographic photosensitive body including an electroconductive substrate, and a charge generating layer, a charge transfer layer and a surface protective layer laminated on the substrate in this order, and a charging roller for causing contact electrification on the surface of the electrophotographic photosensitive body, wherein at least the surface protective layer contains inorganic microparticles having a fluorine compound on the surfaces and a binder resin, and the surface of the charging roller has a maximum height roughness Rz≤0.5 μm.

9 Claims, 2 Drawing Sheets

ELECTROPHOTOGRAPHIC IMAGE FORMING APPARATUS

The entire disclosure of Japanese patent Application No. 2016-241928, filed on Dec. 14, 2016, is incorporated herein by reference in its entirety.

BACKGROUND

Technological Field

The present invention relates to an electrophotographic image forming apparatus. More specifically, the present invention relates to an electrophotographic image forming apparatus that can make granularity fine and can suppress the depletion of an electrophotographic photosensitive body even if printing is conducted for a long period.

Description of the Related Art

Conventional charging rollers were imparted a maximum height roughness Rz of an outermost surface (hereinafter also simply referred to as "surface") of about several micrometers. This is for suppressing pollution of a charging roller during printing, but imparting of the above-mentioned maximum height roughness to the surface of the charging roller was the cause of deterioration of a degree of roughness (hereinafter also referred to as "granularity") of a formed toner image and increase in a depletion amount of an electrophotographic photosensitive body (hereinafter simply referred to as "photosensitive body").

Furthermore, it is known that the granularity in an existing charging process (a process using contact electrification) is inferior to the granularity in a scorotron charging process. Therefore, in order to improve granularity while using an existing charging process, it was necessary to preset a peak-to-peak voltage (hereinafter simply referred to as "$V_{pp}$") and a frequency wave number to be high, but the depletion of a photosensitive body was further accelerated by doing so.

On the other hand, in a charging roller having a surface with a maximum height roughness Rz of 0.5 μm or less (hereinafter referred to as "roughnessless charging roller"), fine granularity can be obtained without presetting $V_{pp}$ and a frequency wave number to be high, and the depletion of a photosensitive body can be suppressed.

However, it has been found that, in a case when printing is conducted for a long period, when pollution occurs on a charging roller by the slip-through of a toner from a cleaning blade (hereinafter simply referred to as "slip-through"), granularity and chargeability tend to be significantly deteriorated with respect to the initial state. This is due to the fact that the surface of a roughnessless charging roller is hard to be refreshed by a cleaning element (brush).

Therefore, in order to adopt a roughnessless charging roller to an electrophotographic image forming apparatus, it is necessary that slip-through does not occur throughout printing for a long period. As a technology for suppressing slip-through, a means for decreasing a torque of a cleaning blade by adding fluorine microparticles or a fluorine resin to a surface protective layer of a photosensitive body is already known (for example, see JP 2005-156653 A and JP 2011-141484 A).

However, since the fluorine atoms segregate in the vicinity of the surface of the photosensitive body in these means, slip-through cannot be suppressed over a long period, and thus these means were insufficient for an electrophotographic image forming apparatus having a roughnessless charging roller.

SUMMARY

The present invention has been made in view of the above-mentioned problems and situations. Therefore, an object of the present invention is to provide an electrophotographic image forming apparatus that can make granularity fine and can suppress the depletion of an electrophotographic photosensitive body even if printing is conducted for a long period.

To achieve the abovementioned object, according to an aspect of the present invention, an electrophotographic image forming apparatus reflecting one aspect of the present invention comprises:

an electrophotographic photosensitive body including an electroconductive substrate, and a charge generating layer, a charge transfer layer and a surface protective layer laminated on the substrate in this order, and a charging roller for causing contact electrification on the surface of the electrophotographic photosensitive body, wherein at least the surface protective layer contains inorganic microparticles having a fluorine compound on the surfaces and a binder resin, and the surface of the charging roller has a maximum height roughness Rz≤0.5 μm.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
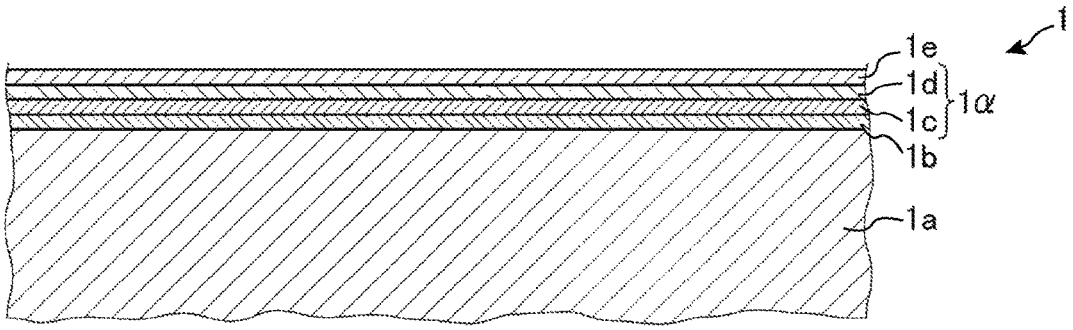
FIG. 1 is a partial cross-sectional view showing an example of the constitution of the electrophotographic photosensitive body of the present invention.

Hereinafter, one or more embodiments of the present invention will be described with reference to the drawings. However, the scope of the invention is not limited to the disclosed embodiments.

The electrophotographic image forming apparatus of the present invention is characterized by being an electrophotographic image forming apparatus including:

an electrophotographic photosensitive body including an electroconductive substrate, and a charge generating layer, a charge transfer layer and a surface protective layer laminated on the substrate in this order, and a charging roller for causing contact electrification on the surface of the electrophotographic photosensitive body, wherein at least the surface protective layer contains inorganic microparticles having a fluorine compound on the surfaces and a binder resin, and the surface of the charging roller has a maximum height roughness Rz≤0.5 μm. This feature is a common or corresponding technical feature among the inventions as claimed in the respective claims. By this way, the present invention can provide effects that the granularity can be fine and the depletion of the photosensitive body can be suppressed even if printing is conducted for a long period.

As an embodiment of the present invention, it is preferable that the surface protective layer includes core-shell type inorganic microparticles as the inorganic microparticles. By this way, the particle size can be increased while ensuring electroconductivity and light permeability, and thus the stability of the electric properties of the photosensitive body and the strength of the surface protective layer can be improved.

As an embodiment of the present invention, it is preferable that the core-shell type inorganic microparticles each contain tin oxide in the shell part. By this way, the electric properties can be stably improved.

As an embodiment of the present invention, it is preferable that the inorganic microparticles have a number average primary particle size within the range of 50 to 500 nm. By this way, the cleaning property and the depletion amount can further be improved.

As an embodiment of the present invention, it is preferable that the fluorine compound is a fluorine atom-containing resin. By this way, the torque of the cleaning blade can be decreased, and the fluorine compound is dispersed easily and more homogeneously.

As an embodiment of the present invention, it is preferable that the fluorine compound is a fluoroalkyl (meth) acrylate/(meth)acrylic acid copolymer. By this way, the fluorine compound can be chemically bonded to the surfaces of the inorganic microparticles through carboxy groups, and thus the effect of fluorine can be expressed more preferably, and eventually the effect of the present invention can be expressed more preferably.

As an embodiment of the present invention, it is preferable that the content of the fluorine compound in the surface protective layer is within the range of 1 to 10% by mass with respect to 100 parts by mass of the inorganic microparticles. By this way, the effect of the present invention can be expressed more preferably.

As an embodiment of the present invention, it is preferable that the surface protective layer includes a cured product obtained by polymerizing an acrylic monomer or a methacrylic monomer as the binder resin. By this way, the strength and cleaning property of the surface protective layer can further be achieved simultaneously.

As an embodiment of the present invention, it is preferable that the content of the inorganic microparticles in the surface protective layer is within the range of 50 to 150% by mass with respect to 100% by mass of the binder resin. By this way, it becomes possible to sufficiently satisfy the hardness, electroconductivity and light permeability of the surface protective layer.

As an embodiment of the present invention, it is preferable to include a mechanism for rotation driving the charging roller. By this way, even when the friction on the surface of the photosensitive body is decreased by the fluorine on the surface, the charging roller can avoid slipping.

The present invention and the constitutional factors thereof, and the embodiments for carrying out the present invention will be explained below in detail. In the present application, "to" is used to mean that the numerical values described before and after the word are contained as a lower limit value and an upper limit value.

<<Summary of Electrophotographic Image Forming Apparatus>>

The electrophotographic image forming apparatus of the present invention is characterized by being an electrophotographic image forming apparatus including:

an electrophotographic photosensitive body including an electroconductive substrate, and a charge generating layer, a charge transfer layer and a surface protective layer laminated on the substrate in this order, and a charging roller for causing contact electrification on the surface of the electrophotographic photosensitive body, wherein at least the surface protective layer contains inorganic microparticles having a fluorine compound on the surfaces and a binder resin, and the surface of the charging roller has a maximum height roughness Rz≤0.5 μm.

[Electrophotographic Photosensitive Body]

In the electrophotographic photosensitive body according to the present invention (hereinafter also simply referred to as "photosensitive body"), a charge generating layer, a charge transfer layer and a surface protective layer are laminated on an electroconductive substrate in this order.

As an example of the specific layer constitution of the photosensitive body according to the present invention, as shown in FIG. 1, a photosensitive body having a layer constitution including an electroconductive substrate 1*a*, and a charge generating layer 1*c* and a charge transfer layer 1*d* as a photosensitive layer 1*a*, and a surface protective layer 1*e* which are laminated in this order on the electroconductive substrate 1*a*, and an intermediate layer 1*b* disposed as necessary in between the electroconductive substrate 1*a*, and the photosensitive layer 1*a* is exemplified.

Alternatively, as another example of the photosensitive body according to the present invention, a photosensitive body having a layer constitution including an electroconductive substrate, and an intermediate layer, a single layer having a charge generating function and a charge transfer function as a photosensitive layer, and a surface protective layer which are laminated in this order on the electroconductive substrate is exemplified.

<Surface Protective Layer>

At least the surface protective layer in the present invention contains inorganic microparticles having a fluorine compound on the surfaces and a binder resin.

The inorganic microparticles having a fluorine compound on the surface is homogeneously distributed in the surface protective layer in the present invention.

The fluorine is homogeneously distributed in the surface protective layer can be confirmed by peeling the surface protective layer of the photosensitive body, preparing a strip, and observing the cross-sectional surface under a scanning electron microscope (SEM). Specifically, it can be confirmed by confirming that the inorganic microparticles having a fluorine compound on the surface is homogeneously distributed in the surface protective layer. Furthermore, that the inorganic microparticles and fluorine are homogeneously distributed can be confirmed by an elemental analysis (XPS) of the cross-sectional surface of the strip of the surface protective layer.

"Homogeneously dispersed" refers to that any flocculated product (a product of 2 μm or more is deemed as a flocculated product) of the microparticles is not observed in the surface protective layer.

(Inorganic Microparticles)

The inorganic microparticles in the present invention have a fluorine compound on the surface.

The inorganic microparticles may be either inorganic microparticles each having a single layer structure, or core-shell type inorganic microparticles each constituted by a core part and a shell part with which the core part is coated. Specifically, it is preferable that the surface protective layer contains core-shell type inorganic microparticles, since the particle size can be increased while ensuring electroconductivity and light permeability, and thus the stability of the electric properties of the photosensitive body and the strength of the surface protective layer can be improved.

In the core-shell type inorganic microparticles, a part of the surface of the core part may be exposed, or the surface of the core part may be completely coated by the shell part.

Examples of the inorganic microparticles having a single layer structure include microparticles of silicon oxide (silica), magnesium oxide, zinc oxide, tin oxide, aluminum oxide (alumina), zirconium oxide, tin oxide, titanium oxide (titania), niobium oxide, molybdenum oxide, vanadium oxide and the like. Among these, titanium oxide and tin oxide are preferable in view of the hardness, electroconductivity and light permeability of the surface protective layer. Furthermore, the inorganic microparticles may be commercially available products, and for example, "NanoTek Powder $SnO_2$" manufactured by C. I. Kasei Co., Ltd. can be used.

The amount of the shell part adhered to the core part is preferably 30 to 80% by mass, more preferably 40 to 70% by mass with respect to the core part.

As the method for attaching the shell part to the core part, for example, the method disclosed in JP 2009-255042 A or the like can be adopted.

In a case where the inorganic microparticles are composite microparticles each having a core-shell structure, an insulating material is used in the core part, specifically, barium sulfate ($BaSO_4$), silicon oxide ($SiO_2$), aluminum oxide ($Al_2O_3$) and the like can be used, and specifically, it is more preferable to use barium sulfate. As the core part, barium sulfate is specifically preferable in view of light permeability.

Furthermore, examples of the metal oxide as the shell part include tin oxide ($SnO_2$), titanium oxide ($TiO_2$), zinc oxide (ZnO), zirconia, indium tin oxide and the like, and it is preferable to include any one of tin oxide ($SnO_2$), zinc oxide (ZnO) and titanium oxide ($TiO_2$), and it is specifically preferable to include tin oxide, in view of electrical resistance, electric property and light permeability.

The core-shell type inorganic microparticles may be either a commercially available product or a product prepared by one's company.

As the commercially available product, for example, "Pastolan 4310" manufactured by Mitsui Mining & Smelting Co., Ltd. can be used.

Furthermore, the method for producing the core-shell type inorganic microparticles may be any known method, and for example, the core-shell type inorganic microparticles can be produced by the method described in JP 2015-144117 A.

In a case where the inorganic microparticles have electroconductivity, the volume resistance thereof is preferably $10^2$ to $10^9$ Ω·cm, more preferably $10^5$ to $10^7$ Ω·cm.

The volume resistance rate is a value measured by a Type TR8611A digital ultrainsulation resistance/microcurrent meter manufactured by Advantest Corporation under an environment at a temperature of 23° C. and a humidity of 50%.

The particle size of the inorganic microparticles is preferably a number average primary particle size of 50 to 500 nm, more preferably a number average primary particle size of 50 to 200 nm. The particle size is measured by a particle size distribution meter. When the number average primary particle size of the inorganic microparticles in the present invention is within the range of 50 to 500 nm, the cleaning property and the depletion amount can further be improved. Furthermore, within this range, the strength and electric property of the surface protective layer can further be improved, and the light permeability can further be improved.

(Method for Measuring Number Average Primary Particle Size)

As the method for measuring the number average primary particle size of the inorganic microparticles of the present invention, the following method is exemplified.

Firstly, an enlarged photograph at 10,000 to 20,000-fold magnification is photographed by a scanning electron microscope (manufactured by JEOL, Ltd.) or the like. Secondly, a photograph image obtained by randomly scanning about 300 particles (flocculated particles are excluded) by a scanner is subjected to calculation by using an automatic image processor "LUZEX AP (software version: Ver. 1.32)" (manufactured by Nireco Corporation), or the like.

The content (addition amount) of the inorganic microparticles in the present invention is preferably within the range of 50 to 150% by mass when the binder resin is deemed as 100% by mass, since the hardness, electroconductivity and light permeability of the surface protective layer can be sufficiently satisfied.

The content of the inorganic microparticles in the present invention can be adjusted by the addition amount during the production. That is, the content can be the above-mentioned content by presetting the addition amount of the inorganic microparticles to be within the range of 50 to 150 parts by mass when the addition amount of the binder resin in the surface protective layer is preset to 100 parts by mass.

(Fluorine Compound)

When the fluorine compound in the present invention is a fluorine atom-containing resin, since the fluorine atom-containing resin is bonded to the surface of the inorganic microparticles at a plurality of reaction points, the adhesion force of the inorganic microparticles is improved, and thus detachment can be prevented. Consequently, the effect of the fluorine can be expressed more preferably, and the torque of the cleaning blade is eventually decreased. Furthermore, as long as any fluorine atom-containing resin is used, in a case where a photosensitive body is produced, when the surface protective layer is applied, the dispersion stability of the inorganic microparticles in the application liquid is improved. Consequently, the fluorine compound can be dispersed more homogeneously, and eventually, the effect of the present invention can be preferably expressed.

Specifically, it is preferable that the fluorine compound is a resin having fluorine atoms at the side chains. Specifically, a resin having a structure in which a part of the side chains of poly(meth)acrylic acid is substituted with a fluoroalkyl is more preferable.

Specifically, as such a fluorine compound, a general compound having a perfluoroalkyl group having lower than 8 carbon atoms can be preferably used. Such a compound may have either a straight chain or a branched chain. Furthermore, specifically, it is preferable that the fluorine compound is a fluoroalkyl (meth)acrylate/(meth)acrylic acid copolymer, since the fluorine compound can be chemically bonded to the surfaces of the inorganic microparticles through the carboxy group, the effect of the fluorine can be expressed more preferably, and the effect of the present invention can be eventually expressed more preferably.

Although it is preferable to have a hydroxy group or a carboxy group as in the acrylate/(meth)acrylic acid copolymer, the fluorine compound is not limited to this copolymer, and any fluorine polymer that is soluble in solvents and is thermoplastic can be used. Specifically, for example, perfluoropolyether (PFPE) can also be used. For example, Fomblin and Fluorolink manufactured by Solvay Specialty Polymers can also be used.

It is preferable that the molecular weight of the fluorine compound is a number average molecular weight of 5,000 to 30,000. The number average molecular weight of the fluorine compound can be measured by gel permeation chromatography (GPC) as mentioned below.

A sample is added to sec-butanol so as to give a concentration of 1 mg/mL, the mixture is subjected to a dispersion treatment at 40° C. by using an ultrasonic dispersion machine for 15 minutes, and treated by a membrane filter having a pore size of 0.2 μm to prepare a sample liquid. Using a GPC apparatus HLC-8120GPC (manufactured by Tosoh Corporation) and a column TSK guard column+a TSK gel Super HZM-M Triplet (manufactured by Tosoh Corporation), sec-butanol is flown as a carrier solvent at a flow rate of 0.2 mL/min while retaining the column temperature at 40° C. 10 μL of the prepared sample liquid is injected in a GPC apparatus together with a carrier solvent, the sample is detected by using a refractive index detector (RI detector), and the molecular weight distribution of the sample is calculated by using a standard curve measured by using single dispersion polystyrene standard particles. The standard curve is prepared by measuring ten polystyrene standard particles (manufactured by Pressure Chemical) having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, respectively.

The content of the fluorine compound in the surface protective layer in the present invention is preferably within the range of 1 to 10% by mass, further preferably, 2 to 6% by mass with respect to 100 parts by mass of the inorganic microparticles. By this way, the dispersibility of the inorganic microparticles is improved, and the surfaces of the inorganic microparticles are homogeneously treated with fluorine. Consequently, the torque between the photosensitive body and the cleaning blade can be decreased, and eventually, the effect of the present invention can be expressed more preferably.

Specifically, a sufficient effect can be expressed if the content is 1% by mass or more, and the electrical resistance is not excessively increased and the electric properties can be fine if the content is 10% by mass or less.

The method for imparting the fluorine compound to the inorganic microparticles (hereinafter also referred to as "surface modification") is not specifically limited, and a wet treatment can be adopted. Specifically, as the surface modification method by a wet treatment, a method in which a solution obtained by dispersing untreated inorganic microparticles and a fluorine compound in a solvent such as 2-butanol is mixed by stirring at a predetermined temperature, the solvent is then removed to give a powder body can be exemplified. Furthermore, the treatment temperature is set to, for example, 20 to 60° C., and the mixing time is set to, for example, 30 to 60 minutes. At this time, an acid such as hydrochloric acid or sulfuric acid may also be added as a catalyst. Furthermore, the obtained powder body may be dried at 80 to 150° C. for 30 to 90 minutes.

By such a method, inorganic microparticles having the fluorine compound in the present invention on the surface can be produced.

(Binder Resin)

The binder resin in the present invention has a three-dimensional crosslinked structure obtained by polymerizing a monomer for a binder resin, and specifically, a crosslinked binder resin in which a three-dimensional crosslinked structure has been formed by initiating the polymerization of a monomer for a binder resin by the action of ultraviolet ray, heat and other energy can be used. As such a binder resin, known binder resins such as the cured resins described in paragraphs 0023 to 0028 of JP 2016-139067 A can be used.

Specifically, it is preferable to incorporate a cured product obtained by polymerizing an acrylic monomer or a methacrylic monomer as the binder resin in the present invention, since the strength of the surface protective layer can further be improved, and the torque between the photosensitive body and the cleaning blade can further be decreased, and consequently, the strength and the cleaning property of the surface protective layer can further be simultaneously achieved. Furthermore, a three-dimensional crosslink-polymerized cured product of an acrylic monomer or a methacrylic monomer having three or more acryloyl groups ($CH_2{=}CHCO{-}$) or methacryloyl groups ($CH_2{=}CCH_3CO{-}$) in the monomer molecule is more preferable.

The method for polymerizing the binder resin is preferably UV curing, but the method is not limited to this method and may be a general method.

Specific example of the above-mentioned acrylic monomer and methacrylic monomer used as the monomer for the binder resin in the present invention include, for example, the exemplified compounds (M1) to (M14) below.

In the chemical formulas representing exemplified compounds (M1) to (M14), R represents an acryloyl group ($CH_2{=}CHCO{-}$), and R' represents a methacryloyl group ($CH_2{=}CCH_3CO{-}$).

[Chemical Formula 1]

M1

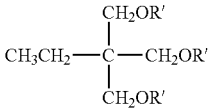

M2

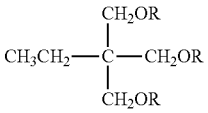

M3

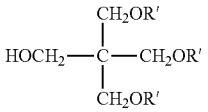

M4

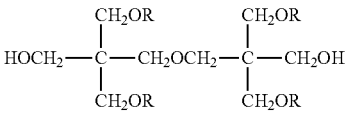

M5

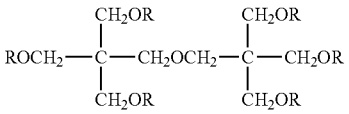

M6

$CH_3CH_2C{-}(CH_2OC_3H_6OR)_3$

M7

$CH_3CH_2C{-}(CH_2CH_2OR)_3$

-continued

[Chemical Formula 2]

M8

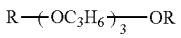

M9

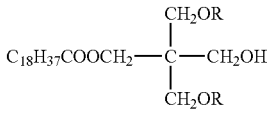

M10

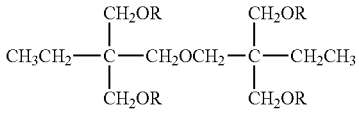

M11

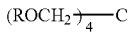

M12

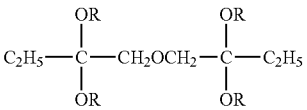

M13

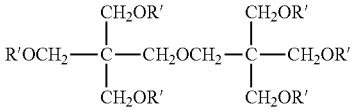

M14

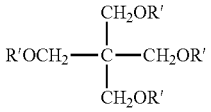

<Electroconductive Substrate>

The electroconductive substrate that constitutes the photosensitive body according to the present invention may be any substrate as long as it has electroconductivity, and specific examples include metals such as aluminum, copper, chromium, nickel, zinc and stainless which have been formed into a drum or sheet-like shape, plastic films on which a metal foil of aluminum, copper or the like is laminated, plastic film on which aluminum, indium oxide, tin oxide or the like is deposited, metals, plastic films and paper sheets on which an electroconductive layer is disposed by applying an electroconductive substance alone or together with a binder resin, and the like.

(Intermediate Layer)

In the photosensitive body according to the present invention, in view of prevention of breakdown, it is preferable to dispose an intermediate layer having a barrier function and an adhesion function between the electroconductive substrate and the photosensitive layer. This intermediate layer is formed by containing, for example, a binder resin (hereinafter also referred to as "a binder resin for an intermediate layer"), and metal oxide particles as necessary.

Examples of the binder resin for an intermediate layer include casein, polyvinyl alcohols, nitrocellulose, ethylene-acrylic acid copolymers, polyamide resins, polyurethane resins, gelatin and the like. Among these, alcohol-soluble polyamide resins are preferable.

The metal oxide particles are used for the purpose of adjusting the resistance, and as specific examples, for example, particles formed of various metal oxides such as alumina, zinc oxide, titanium oxide, tin oxide, antimony oxide, indium oxide and bismuth oxide can be used, and particles formed of tin-doped indium oxide, antimony-doped tin oxide and zirconium oxide, and the like can be used.

Furthermore, the metal oxide particles may be used by one kind alone or by mixing two or more kinds. In a case where two or more kinds are mixed, the metal oxide particles may have a form of a solid-solution or a melt-bonded form.

The number primary average particle size of the metal oxide particles is preferably 0.3 μm or less, more preferably 0.1 μm or less.

The content rate of the metal oxide particles in the intermediate layer is preferably 20 to 400 parts by mass, more preferably 50 to 350 parts by mass with respect to 100 parts by mass of the binder resin for an intermediate layer.

The layer thickness of the intermediate layer is preferably 0.1 to 15 μm, more preferably 0.3 to 10 μm.

(Photosensitive Layer)

As the photosensitive layer that constitutes the photosensitive body according to the present invention, a photosensitive layer having a charge generating layer and a charge transfer layer will be explained in detail.

(Charge Generating Layer)

The charge generating layer in the photosensitive layer that constitutes the photosensitive body according to the present invention is a charge generating layer containing a charge generating substance and a binder resin (hereinafter also referred to as "binder resin for a charge generating layer").

As the binder resin for a charge generating layer, known resins can be used, and specific examples include polystyrene resins, polyethylene resins, polypropylene resins, acrylic resins, methacrylic resins, vinyl chloride resins, vinyl acetate resins, polyvinyl butyral resins, epoxy resins, polyurethane resins, phenolic resins, polyester resins, alkyd resins, polycarbonate resins, silicone resins, melamine resins, and copolymer resins containing two or more of these resins (for example, vinyl chloride-vinyl acetate copolymer resins, vinyl chloride-vinyl acetate-maleic anhydride copolymer resins), polyvinyl carbazole resins, and the like. Among these resins, polyvinyl butyral resins are preferable.

The charge generating substance is not specifically limited, and specific examples include azo pigments such as Sudan Red and Diane Blue; quinone pigments such as pyrenequinone and anthanthrone; indigo pigments such as quinocyanine pigments, perylene pigments, indigo and thioindigo; polycyclic quinone pigments such as pyranthrone and diphthaloylpyrene; phthalocyanine pigments; and the like. Among these compounds, polycyclic quinone pigments and titanylphthalocyanine pigments are preferable. Furthermore, these compounds can be used by one kind alone or by mixing two or more kinds.

The content rate of the charge generating substance in the charge generating layer is preferably 1 to 600 parts by mass, more preferably 50 to 500 parts by mass with respect to 100 parts by mass of the binder resin for a charge generating layer.

The layer thickness of the charge generating layer is suitably defined according to the property of the binder resin for a charge generating layer, and the property and content rate of the charge generating substance, and the like, and is preferably 0.01 to 5 μm, more preferably 0.05 to 3 μm.

(Charge Transfer Layer)

The charge transfer layer in the photosensitive layer that constitutes the photosensitive body according to the present invention contains a charge transfer substance and a binder resin (hereinafter also referred to as "a binder resin for a charge transfer layer").

As the binder resin for a charge transfer layer, known resins can be used, and specific examples include polycarbonate resins, polyacrylate resins, polyester resins, polystyrene resins, styrene-acrylonitrile copolymer resins, polymethacrylic acid ester resins, styrene-methacrylic acid ester copolymer resin and the like, and polycarbonate resins are preferable. Furthermore, as the polycarbonate resins, BPA (Bisphenol A) type, BPZ (Bisphenol Z) type, dimethyl BPA type, BPA-dimethyl BPA copolymer type polycarbonate resins are preferable in view of crack resistance, wearing resistance and charging property.

Examples of the charge transfer substance include substances that transfer electrical charge (holes) such as triphenylamine derivatives, hydrazone compounds, styryl compounds, benzidine compounds, butadiene compounds and the like.

The content rate of the charge transfer substance in the charge transfer layer is preferably 10 to 500 parts by mass, more preferably 20 to 250 parts by mass with respect to 100 parts by mass of the binder resin for a charge transfer layer.

The layer thickness of the charge transfer layer differs depending on the property of the binder resin for a charge transfer layer, and the property and content rate of the charge transfer substance, and the like, and is preferably 5 to 40 μm, more preferably 10 to 30 μm.

Furthermore, the charge transfer layer may contain an antioxidant, an electron conductant agent, a stabilizer, a silicone oil and the like.

As the antioxidant, those disclosed in JP 2000-305291 A and the like are preferable, and as the electron conductant agent, those disclosed in JP 50-137543 A and JP 58-76483 A and the like are preferable.

<<Electrophotographic Image Forming Apparatus>>

As the electrophotographic image forming apparatus of the present invention (hereinafter simply referred to as "image forming apparatus") herein, known constitutions can be preferably adopted, except for the above-mentioned electrophotographic photosensitive body and the charging roller mentioned below, within the scope in which the expression of the effect of the present invention is not inhibited.

Hereinafter the charging roller in the present invention is explained in detail, and the other constitutions are simply explained.

Figure 2:
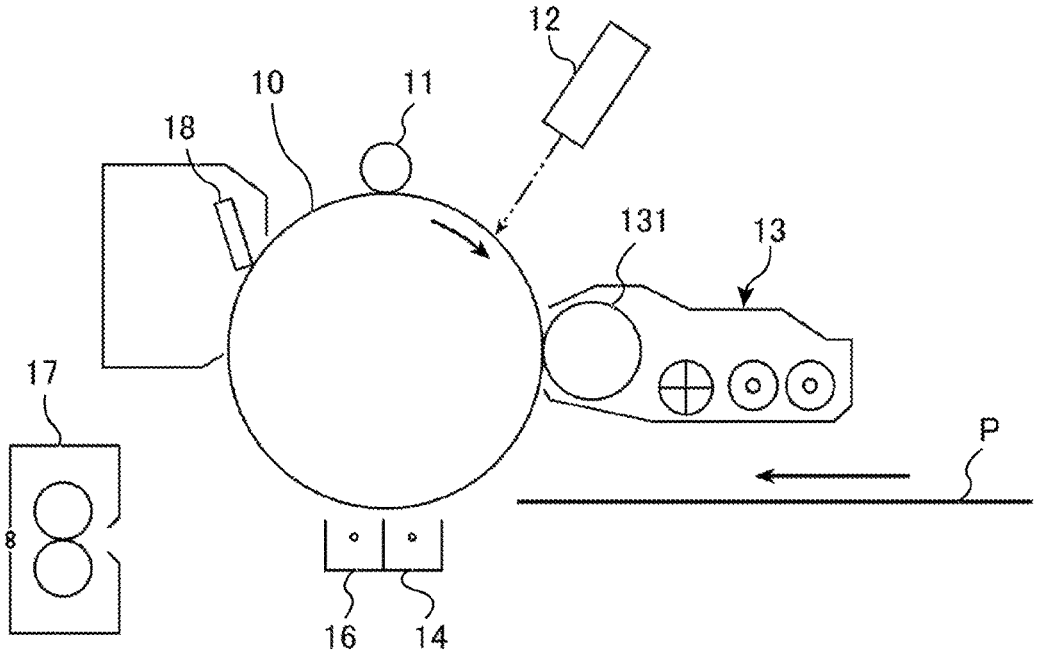
FIG. 2 is a schematic view showing an example of the constitution of the image forming apparatus of the present invention.

FIG. 2 is a cross-sectional view for explaining an example of the image forming apparatus of the present invention.

This image forming apparatus includes the photosensitive body according to the present invention 10; a charging means including a charging roller 11 that gives an even potential to the surface of the photosensitive body 10 by corona discharging at the same polarity as that of a toner, and the like; an exposing means 12 that forms an electrostatic latent image by exposing an image based on image data by a polygon mirror or the like on the surface of the evenly-charged photosensitive body 10; a developing means 13 including a rotatable developing sleeve 131, which forms a toner image by transferring a toner retained on the developing sleeve 131 to the surface of the photosensitive body 10, and develops the above-mentioned electrostatic latent image to form a toner image; a transfer means 14 that transfers the toner image to an image substrate P as necessary; a separation means 16 that separates the image substrate from the photosensitive body 10; a fixing means 17 for fixing the toner image on the image substrate P; and a cleaning means having a cleaning blade 18 for removing the residual toner on the photosensitive body 10.

[Charging Roller]

The charging roller in the present invention causes contact electrification on the surface of the electrophotographic photosensitive body.

The maximum height roughness of the surface of the charging roller is preferably Rz≤0.5 μm, and is more preferably as small as possible.

The electrical resistance of the charging roller in the present invention is preferably $1.0\times10^2$ to $1.0\times10^8\Omega$, more preferably $1.0\times10$ to $1.0\times10^6\Omega$.

In the present invention, the contact electrification refers to an embodiment in which the charging roller is disposed in contact with the photosensitive body, and the surface of the photosensitive body is charged by applying alternating current voltage or a direct current voltage, or both of the current voltages.

<Maximum Height Roughness of Surface of Charging Roller>

The maximum height roughness Rz of the surface of the charging roller in the present invention can be calculated from a roughness curve of the surface measured according to JIS B0601:2013. The roughness curve can be measured by a stylus surface roughness meter based on JIS B0601: 2013, a non-contact surface analyzer using laser or the like, or the like.

As the measurement conditions in a case where a stylus surface roughness meter is used, the following conditions are exemplified.

(Measurement Conditions)

Measurement apparatus: Surfcom 1400D (manufactured by Tokyo Seimitsu Co., Ltd.)

Measurement mode: roughness measurement

Measurement length: 20.0 mm

Cutoff: 0.08 mm (Gaussian)

Measurement velocity: 0.15 mm/sec

<Method for Measuring Electrical Resistance of Charging Roller>

The charging roller is brought into contact with a metal roller (diameter: 30 mm). Secondly, a load of 4.9 N is applied to each of the core metal parts of the both ends of the charging roller such that the charging roller is pressurized to abut on the metal roller. Thereafter, an electrical resistance value when a voltage of DC=−500 V is applied for 5 seconds to the entirety of the core of the charging roller while the metal roller is rotated at 30 rpm is read as an average value, and is deemed as the electrical resistance of the charging roller.

(Measurement Conditions)

Metal roller rotation number=30 rpm

Application time=5 sec

Load=4.9 N×2

Measurement value=average value of max and min of electrical resistance (i.e., {maximum value of electrical resistance+minimum value of electrical resistance}/2.)

<Specific Example of Constitution of Charging Roller>

Figure 3:
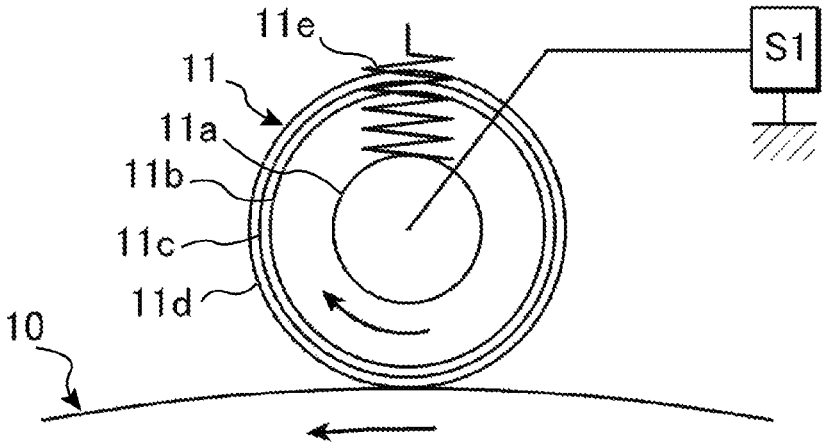
FIG. 3 is a schematic view showing an example of the constitution of the charging roller in the image forming apparatus FIG. 2.

As shown in FIG. 3, the charging roller 11 has a constitution such that a resistance controlling layer 11*c* for the charging roller 11 to obtain highly homogeneous electrical resistance as a whole is laminated as necessary on the surface of an elastic layer 11*b*, which is laminated on a surface of a core metal 11*a* and for decreasing sound of charging and imparting elasticity to thereby give homogeneous adhesion to the photosensitive body 10, and a charging roller surface layer 11*d* is laminated on the resistance controlling layer 11*c* and the laminate is biased in the direction of the photosensitive body 10 by a pressurizing spring lie pressurized at a predetermined pressure on the surface of the photosensitive body 10 to form a charging nip part, and the charging roller 11 rotates by following the rotation of the photosensitive body 10.

The mechanism for rotating and driving the charging roller is not specifically limited, and examples include a system as mentioned above in which the charging roller is rotated by following the photosensitive body, and a system in which the charging roller is driven and rotated by transmitting a motive power from outside. Of these, the system in which the charging roller is driven and rotated by transmitting a motive power from outside is preferable. Even in a case where a roughnessless charging roller is used, the charging roller does not slip due to insufficient following of the photosensitive body by driving rotation, and thus charging defect and image defect due to the slip can be avoided. Accordingly, charging can be conducted more stably by driving rotation.

The system in which the charging roller is driven and rotated by transmitting a motive power from outside may be a known method, and examples include, but are limited to, gear driving branched from the driving system of the photosensitive body.

The above-mentioned core metal 11*a*, elastic layer 11*b*, resistance controlling layer 11*c* and charging roller surface layer 11*d* are not specifically limited and known ones can be used, and for example, those described in paragraphs 0098 to 0108 of JP 2016-139067 A can be used.

In the charging roller 11 mentioned above, the surface of the photosensitive body 10 is charged to a predetermined potential at a predetermined polarity by the application of a charging bias voltage from a power source S1 to the core metal 11*a* of the charging roller 11. The charging bias voltage herein is, for example, an oscillation voltage in which an alternating current voltage ($V_{ac}$) is superimposed on a direct current voltage ($V_{dc}$).

This charging roller 11 is deemed to have a length based on the longitudinal direction length of the photosensitive body 10.

In this image forming apparatus, the toner image formed on the photosensitive body 10 is transferred by a transfer means 14 onto an image substrate P, which is carried at a simultaneous timing, separated from the photosensitive body 10 by a separation means 16 and fixed on a fixing means 17, whereby a visible image is formed.

In addition, the exemplary embodiment to which the present invention can be applied is not limited to the above-mentioned exemplary embodiment, and can be suitably modified within the scope that does not deviate from the purport of the present invention.

Examples

Hereinafter the present invention will be specifically explained with referring to Examples, the present invention is not limited to these Examples. In this Examples, the indication of "part" or "%" is used, and unless otherwise mentioned, the indication represents "parts by mass" or "% by mass".

[Preparation of Electrophotographic Photosensitive Body]

The electrophotographic photosensitive bodies to be used in Examples 1 to 12 and Comparative Examples 1 to 8 were prepared. The electrophotographic photosensitive bodies to be used in Examples 1 to 12 and Comparative Examples 1 to 8 were prepared by a common method up to the charge generating layer, but the surface protective layer formed on the charge generating layer was different among the photosensitive bodies. Therefore, in the following, up to the formation of the charge generating layer will be mentioned first, and the methods for forming the surface protective layer possessed by the photosensitive bodies used in Examples 1 to 12 and Comparative Examples 1 to 8 will be respectively mentioned.

(Electroconductive Substrate)

An electroconductive substrate [1] was prepared by subjecting the surface of a cylindrical body made of aluminum having a diameter of 30 mm to a cutting work, and finely roughening the surface.

(Formation of Intermediate Layer)

A dispersion liquid including 1 part by mass of a polyamide resin "CM8000" (manufactured by Toray Industries, Inc.) as a binder resin, 3 parts by mass of titanium oxide "SMT500SAS" (manufactured by Tayca Corporation) as metal oxide particles and 10 parts by mass of methanol as a solvent was diluted with methanol to twice, allowed to stand still overnight and filtered (filter; a Rigimesh 5 μm filter manufactured by Pall Corporation Japan) was used, whereby an application liquid [1] for forming an intermediate layer was prepared.

The obtained application liquid [1] for forming an intermediate layer was applied onto an electroconductive substrate [1] by an immersion coating process to form an intermediate layer [1] having a dry film thickness (layer thickness) of 2 μm.

(Formation of Charge Generating Layer)

20 parts by mass of the following pigment (CG-1) as a charge generating substance, 10 parts by mass of a polyvinyl butyral resin "#6000-C" (manufactured by Denka Co., Ltd.) as a binder resin, 700 parts by mass of t-butyl acid as a solvent, and 300 parts by mass of 4-methoxy-4-methyl-2-pentanone were mixed, and dispersed by using a sand mill for 10 hours to prepare an application liquid [1] for forming a charge generating layer.

The obtained application liquid [1] for forming a charge generating layer was applied onto the intermediate layer [1] by an immersion coating process to form a charge generating layer [1] having a dry film thickness (layer thickness) of 0.3 μm.

(Synthesis of Pigment (CG-1))

(1) Synthesis of Amorphous Titanyl Phthalocyanine 29.2 parts by mass of 1,3-diiminoisoindoline was dispersed in 200 parts by mass of o-dichlorobenzene, 20.4 parts by mass of titanium tetra-n-butoxide was added thereto, and the mixture was heated under a nitrogen atmosphere at 150 to 160° C. for 5 hours. The product was cooled, and the precipitated crystalline was filtered, washed with chloroform, washed with a 2% aqueous hydrochloric acid solution, washed with water and methanol, and dried to give 26.2 parts by mass (yield: 91%) of crude titanyl phthalocyanine.

The crude titanyl phthalocyanine is then dissolved by stirring at 5° C. or less in 250 parts by mass of concentrated sulfuric acid for 1 hour, and this solution was poured into 5,000 parts by mass of water at 20° C. The precipitated crystalline was filtered and sufficiently washed with water to give 225 parts by mass of a wet paste product.

The obtained wet paste product was frozen in a freezer, thawed again, then filtered and dried to give 24.8 parts by mass of amorphous titanyl phthalocyanine (yield: 86%).

(2) Synthesis of (2R,3R)-2,3-Butanediol Adduct Titanyl Phthalocyanine (Pigment (CG-1))

10.0 parts by mass of the above-mentioned amorphous titanyl phthalocyanine and 0.94 parts by mass of (2R,3R)-2,3-butanediol (0.6 equivalent ratio) (the equivalent ratio is a ratio relative to titanyl phthalocyanine, the same applies hereafter) were mixed in 200 parts by mass of orthodichlorobenzene (ODB), and the mixture was stirred under heating at 60 to 70° C. for 6.0 hours. The product was left overnight, methanol was added thereto, the resulted crystalline was filtered, and the filtered crystalline was washed with methanol to give 10.3 parts by mass of pigment (CG-1) (a pigment containing (2R,3R)-2,3-butanediol adduct titanyl phthalocyanine).

Furthermore, when the obtained pigment (CG-1) was analyzed, the X-ray diffraction spectrum had clear peaks at 8.30, 24.7°, 25.1° and 26.5° and the mass spectrum had peaks at 576 and 648, and in the IR spectrum, two absorption spectra appeared: an absorption spectrum of Ti═O in the vicinity of 970 $cm^{-1}$ and an absorption spectrum of O—Ti—O at 630 $cm^{-1}$. Furthermore, in the thermal analysis (TG), about 7% of mass loss was seen at 390 to 410° C. It is presumed from those analysis results that the pigment (CG-1) was a mixture of a 1:1 adduct of titanyl phthalocyanine and (2R,3R)-2,3-butanediol, and non-adduct (not added) titanyl phthalocyanine.

Furthermore, the BET specific surface area of the obtained pigment (CG-1) was measured by a flow-type specific surface area automatic measuring apparatus (Micrometrix-Flowsorb: Shimadzu Corporation), and found to be 31.2 $m^2/g$.

<Formation of Surface Protective Layers for Photosensitive Bodies Used in Examples 1 to 6, 9 and 10, and Comparative Examples 1 to 3>

5 g of core-shell type inorganic microparticles each having a core part and a shell part formed by the core material and shell material described in Table I (number average primary particle size: 100 nm) were added to 40 g of 2-butanol, the mixture was dispersed by using a US homogenizer for 60 minutes, 10 g of methyl perfluorobutyl ether was then added thereto, 0.15 g of the fluorine compound described in Table I was further added, and the mixture was further dispersed by using the US homogenizer for 60 minutes. The dispersion was conducted while the particle size was confirmed by a particle size distribution meter. After the dispersion, the solvent was volatilized under room temperature, and the obtained powder body was sieved with sieves of 100 μm and 60 μm, and dried at 80° C. for 60 minutes to prepare inorganic microparticles having the fluorine compound described in Table I on the surface.

100 parts by mass of the inorganic microparticles prepared as above, 100 parts by mass of a multifunctional radical polymerizable compound SR350, 400 parts by mass of a solvent: 2-butanol, and 40 parts by mass of a solvent: THF (tetrahydrofuran) were mixed under light shielding, the mixture was dispersed by using a sand mill as a dispersing machine for 5 hours, 10 parts by mass of a polymerization initiator: IRGACURE819 was added thereto and dissolved by stirring under light shielding to prepare an application liquid for forming a surface protective layer. This application liquid for forming a surface protective layer was applied onto the above-mentioned charge transfer layer by using a circular slide hopper application apparatus to form a coating, and the coating was irradiated with ultraviolet ray by using a metal halide lamp for 1 minute. By this way, a surface protective layer having a dry film thickness of 3.0 μm was formed, and the photosensitive bodies used in Examples 1 to 6, 9 and 10 and Comparative Examples 1 to 3 were prepared by using this surface protective layer.

(Method for Measuring Number Average Primary Particle Size)

The number average primary particle size of the inorganic microparticles was measured as follows.

Firstly, the photosensitive layer including the surface protective layer was cut out of the photosensitive body with a knife and attached to an optional holder so that the cross-sectional surface was in an upward direction, whereby a measurement sample was prepared. An enlarged photograph of 10,000-fold of the measurement sample was photographed by a scanning electron microscope (manufactured by JEOL, Ltd.). A number average primary particle size was calculated by analyzing a photograph image obtained by randomly scanning 300 particles by a scanner (except for flocculated particles) by using an automatic image processing analyzer "LUZEX AP (software version Ver. 1. 32)" (manufactured by Nireco Corporation).

<Formation of Surface Protective Layer for Photosensitive Bodies Used in Examples 7 and 8 and 11 and 12>

A surface protective layer was prepared in a similar manner to that of Example 1, except that the kind and treatment amount of the added fluorine compound were changed as described in Table I.

<Preparation of Photosensitive Bodies Used in Comparative Examples 4 to 8>

The photosensitive bodies used in Comparative Examples 4 to 8 were prepared in a similar manner to that of Example 1, except that the core-shell type inorganic microparticles were not subjected to surface modification with a fluorine compound.

TABLE I

| | Photosensitive body | | | | | | | | |
|---|---|---|---|---|---|---|---|---|---|
| | Inorganic microparticles | | | | | | | | |
| | | | Fluorine compound | | | | | | |
| | Core material | Shell material | Kind | Amount of treatment with fluorine compound [% by mass] | Addition amount [% by mass] | Number average primary particle diameter [nm] | Binder resin species | Charging roller Maximum height roughness Rz [μm] | Note |
| Example 1 | $BaSO_4$ | $SnO_2$ | 3M Novec | 5.0 | 100 | 100 | SR350 | 0.2 | Present invention |
| Example 2 | | | | | | | | 0.5 | Present invention |
| Example 3 | | | Daikin | | | | | 0.2 | Present invention |
| Example 4 | | | MS-600 | | | | | 0.5 | Present invention |
| Example 5 | | | Solvay | | | | | 0.2 | Present invention |
| Example 6 | | | MT70 | | | | | 0.5 | Present invention |
| Example 7 | | | 3M Novec | 1.0 | | | | 0.2 | Present invention |
| Example 8 | | | | 10.0 | | | | 0.2 | Present invention |
| Example 9 | $SiO_2$ | | | 5.0 | | | | 0.2 | Present invention |
| Example 10 | $Al_2O_3$ | | | | | | | 0.2 | Present invention |

TABLE I-continued

| | Photosensitive body | | | | | | | | |
|---|---|---|---|---|---|---|---|---|---|
| | Inorganic microparticles | | | | | | | | |
| | | | Fluorine compound | | | | | | |
| | Core material | Shell material | Kind | Amount of treatment with fluorine compound [% by mass] | Addition amount [% by mass] | Number average primary particle diameter [nm] | Binder resin species | Charging roller Maximum height roughness Rz [μm] | Note |
| Example 11 | $BaSO_4$ | | | 0.5 | | | | 0.2 | Present invention |
| Example 12 | | | | 12.0 | | | | 0.2 | Present invention |
| Comparative Example 1 | | | | 5.0 | | | | 1.0 | Comparative Example |
| Comparative Example 2 | | | | | | | | 5.0 | Comparative Example |
| Comparative Example 3 | | | | | | | | 10.0 | Comparative Example |
| Comparative Example 4 | | | — | — | | | | 0.2 | Comparative Example |
| Comparative Example 5 | | | | | | | | 0.5 | Comparative Example |
| Comparative Example 6 | | | | | | | | 1.0 | Comparative Example |
| Comparative Example 7 | | | | | | | | 5.0 | Comparative Example |
| Comparative Example 8 | | | | | | | | 10.0 | Comparative Example |

In Table I,
"3M Novec" represents Novec2702 manufactured by 3M.
"Daikin MS-600" represents Daifree MS-600 manufactured by Daikin Industries, Ltd.
"Solvay MT70" represents Fomblin MT70 manufactured by Solvay Specialty Polymers, and these are all resins containing fluorine atoms.
Furthermore, "3M Novec" and "Daikin MS-600" contain "a fluoroalkyl (meth)acrylate/(meth)acrylic acid copolymer".
SR350 represents trimethylolpropane trimethacrylate.

<<Evaluation>>

Examples 1 to 12 and Comparative Examples 1 to 8 were evaluated as follows.

The evaluation was conducted by putting each photosensitive body to be evaluated on "bizhub C558" (manufactured by Konica Minolta). As an exposing light source for the evaluation instrument "bizhub C558", a semiconductor laser at a wavelength of 780 nm was used. A long period printing test was conducted under an environment at a temperature of 20° C. and a humidity of 50%, the cleaning property and depletion amount of the photosensitive body, and the granularity (image quality) of an output image were evaluated. The long period printing test was conducted by printing letter images each having a printing image ratio of 5% on one surface of each of 300,000 sheets of A4 paper.

<Cleaning Property>

The cleaning property of the photosensitive body was evaluated from the degree of the pollution of the charging roller after the long period printing test.

In a case where slip-through of a toner from a cleaning blade occurs due to long period printing, streak-like pollution attaches to the periphery direction of a charging roller. Therefore, the cleaning property of the photosensitive body was evaluated by the number of the streaks of the pollution.

Regarding the cleaning property, the evaluation criteria were preset as follows. Here, ⦿ and ○ represent acceptable, and Δ and x represent unacceptable.

⦿: streak-like pollution≤2 streaks
○: 2 streaks<streak-like pollution≤5 streaks
Δ: 5 streaks<streak-like pollution≤8 streaks
x: 8 streaks<streak-like pollution <Depletion Amount>

The difference in the film thickness of the photosensitive body before and after the long period printing test was calculated as a depletion amount (μm). The film thickness of the photosensitive body refers to a distance from the surface of the electroconductive substrate to the surface of the surface protective layer.

The film thickness of the photosensitive body was measured by using an eddy current-type film thickness meter.

Specifically, the film thickness of the photosensitive body was measured as follows: the interval from the position at 10 mm on the upper end in the direction orthogonal to the lamination direction to the position at 10 mm on the lower end was measured at every 10 mm interval, and the average value of thereof was deemed as the film thickness of the photosensitive body.

For the depletion amount of the photosensitive body, the evaluation criteria were preset as follows. Here, ⦿ and ○ represent acceptable, and Δ and x represent unacceptable.

⦿: depletion amount≤0.2 μm
○: 0.2 μm<depletion amount≤0.3 μm
Δ: 0.3 μm<depletion amount≤0.4 μm
x: 0.4 μm<depletion amount <Granularity>

The granularities before ("Initial" in Table II) and after ("After long period printing" in Table II) the long period printing test were evaluated by using a soft tone image. Here, the soft tone refers to a color tone that is classified into a color that creates a gentle and soft atmosphere and is obtained by adding only slight dullness to a bright color.

The granularities were evaluated as follows: patch images of eight soft tones; #cc6666, #cc9966, #cccc66, #99cc66, #66cc66, #66cc99, #66cccc and #6699cc were output from Web Safe Color at a printer mode (a mode in which data is sent to an electrophotographic image forming apparatus from a device such as a personal computer, and the data is printed by the image forming apparatus), and the granularity of each image was comprehensively evaluated.

For the granularity, the evaluation criteria were preset as follows. Here, ⊙ and ○ represent acceptable, and Δ and x represent unacceptable.

⊙: When observed through a loupe of 10-fold magnification, homogeneous half tone images with fine textures were replicated in all of the patch images.

○: No problem was seen by naked eyes in the granularity of all of the patch images, but when observed through a loupe of 10-fold magnification, granularity was slightly rough in some of the patch images.

Δ: Slight granule-like roughness was confirmed by naked eyes in some of the patch images.

x: Granule-like roughness was confirmed by naked eyes in some of the patch images, and thus the images looked rough.

TABLE II

| | Evaluated items | | | | |
|---|---|---|---|---|---|
| | Photosensitive body | | Granularity | | |
| | Cleaning property | Amount of depletion | Initial | After printing for long period | Note |
| Example 1 | ⊙ | ⊙ | ⊙ | ⊙ | Present invention |
| Example 2 | ⊙ | ⊙ | ⊙ | ⊙ | Present invention |
| Example 3 | ⊙ | ⊙ | ⊙ | ⊙ | Present invention |
| Example 4 | ⊙ | ⊙ | ⊙ | ⊙ | Present invention |
| Example 5 | ○ | ⊙ | ○ | ○ | Present invention |
| Example 6 | ○ | ⊙ | ○ | ○ | Present invention |
| Example 7 | ⊙ | ⊙ | ⊙ | ⊙ | Present invention |
| Example 8 | ⊙ | ⊙ | ⊙ | ⊙ | Present invention |
| Example 9 | ⊙ | ⊙ | ⊙ | ⊙ | Present invention |
| Example 10 | ⊙ | ⊙ | ⊙ | ⊙ | Present invention |
| Example 11 | ○ | ○ | ⊙ | ○ | Present invention |
| Example 12 | ○ | ○ | ⊙ | ○ | Present invention |
| Comparative Example 1 | ⊙ | ○ | Δ | Δ | Comparative Example |
| Comparative Example 2 | ⊙ | Δ | Δ | Δ | Comparative Example |
| Comparative Example 3 | ⊙ | X | X | X | Comparative Example |
| Comparative Example 4 | X | Δ | ⊙ | X | Comparative Example |
| Comparative Example 5 | X | Δ | ⊙ | X | Comparative Example |
| Comparative Example 6 | X | X | Δ | X | Comparative Example |
| Comparative Example 7 | X | X | Δ | X | Comparative Example |
| Comparative Example 8 | X | X | X | X | Comparative Example |

(Summary)

Table II indicates that the present invention can provide an electrophotographic image forming apparatus that can suppress the depletion of an electrophotographic photosensitive body even if printing is conducted for a long period.

Furthermore, as mentioned above, it is indicated that, since the photosensitive body has a surface protective layer in which inorganic microparticles having a fluorine compound on the surfaces are dispersed in the present invention, even if printing is conducted for a long period by using an electrophotographic image forming apparatus having a charging roller having a low surface maximum height roughness, pollution does not occur on the charging roller, and the granularity can be improved.

In addition, in the surface protective layers of Examples 1 to 12 and Comparative Examples 1 to 3, the maximum height roughness was measured by using a contact system surface roughness meter, and the surface was observed by an SEM, whereby it was confirmed that any flocculates of microparticles were not present on the surface protective layer, and that the inorganic microparticles were homogeneously dispersed.

Furthermore, Examples 1 to 4 and 7 to 12 indicate that the fluorine compound is chemically bonded to the surfaces of the inorganic microparticles, and the adhesion force against the inorganic microparticles increases by using Daikin MS-600 and 3M Novec, which are fluoroalkyl (meth)acrylate/(meth)acrylic acid copolymers, as the fluorine compound, and consequently the fluorine compound is hard to peel from the inorganic microparticles, and thus the cleaning property can be fine even after printing for a long period.

Although embodiments of the present invention have been described and illustrated in detail, the disclosed embodiments are made for purposes of illustration and example only and not limitation. The scope of the present invention should be interpreted by terms of the appended claims.

What is claimed is:

1. An electrophotographic image forming apparatus comprising:

an electrophotographic photosensitive body including an electroconductive substrate, and a charge generating layer, a charge transfer layer and a surface protective layer laminated on the substrate in this order, and a charging roller for causing contact electrification on the surface of the electrophotographic photosensitive body, wherein at least the surface protective layer contains a binder resin and core-shell type inorganic microparticles having a fluorine compound on the surfaces of the core-shell type inorganic microparticles, wherein each of the microparticles contains a core and a shell, and the core and the shell contain inorganic compounds, and the surface of the charging roller has a maximum height roughness Rz≤0.5 μm.

2. The electrophotographic image forming apparatus according to claim 1, wherein the core-shell type inorganic microparticles each contain tin oxide in the shell.

3. The electrophotographic image forming apparatus according to claim 1, wherein the inorganic microparticles have a number average primary particle size within the range of 50 to 500 nm.

4. The electrophotographic image forming apparatus according to claim 1, wherein the fluorine compound is a fluorine atom-containing resin.

5. The electrophotographic image forming apparatus according to claim 1, wherein the fluorine compound is a fluoroalkyl (meth)acrylate/(meth)acrylic acid copolymer.

6. The electrophotographic image forming apparatus according to claim 1, wherein the content of the fluorine compound in the surface protective layer is within the range of 1 to 10% by mass with respect to 100 parts mass of the inorganic microparticles.

7. The electrophotographic image forming apparatus according to claim 1, wherein the surface protective layer contains a cured product obtained by polymerizing an acrylic monomer or a methacrylic monomer as the binder resin.

8. The electrophotographic image forming apparatus according to claim 1, wherein the content of the inorganic microparticles in the surface protective layer is within the range of 50 to 150% by mass with respect to 100% by mass of the binder resin.

9. The electrophotographic image forming apparatus according to claim 1, comprising a mechanism for rotation driving the charging roller.

* * * * *